US005336018A

United States Patent [19]

Maudal

[11] Patent Number: 5,336,018

[45] Date of Patent: Aug. 9, 1994

[54] TIDAL SYSTEM AND METHOD FOR CLEANSING A HARBOR

[76] Inventor: Inge Maudal, 604 Lassen La., Costa Mesa, Calif. 92626

[21] Appl. No.: 880,901

[22] Filed: May 8, 1992

Related U.S. Application Data

[63] Continuation of Ser. No. 497,489, Mar. 22, 1990, abandoned.

[51] Int. Cl.[5] ..... E02B 1/00

[52] U.S. Cl. ..... 405/52; 405/36; 405/74; 137/236.1

[58] Field of Search ..... 405/36, 37, 51, 52, 405/60, 81, 83, 84, 99, 100, 74; 137/236.1, 843

[56] References Cited

U.S. PATENT DOCUMENTS

| | | | |
|---|---|---|---|
| Re. 27,353 | 5/1972 | Shettel . | |
| 3,667,24 | 6/1972 | De Lizasoain . | |
| 833,544 | 10/1906 | Parker | 405/80 |
| 931,513 | 5/1909 | Crawford . | |
| 1,094,310 | 4/1914 | Deal | 405/74 |
| 1,334,354 | 3/1920 | Dodd . | |
| 3,492,822 | 2/1970 | Josephs . | |
| 3,543,521 | 12/1970 | Aubert . | |
| 3,733,830 | 5/1973 | Jacobs . | |
| 3,889,710 | 6/1975 | Brost | 137/843 X |
| 3,952,522 | 4/1976 | Shettel | 405/37 |
| 4,162,864 | 7/1979 | Maeda et al. | 405/75 |
| 4,298,471 | 11/1981 | Dunkers | 405/52 X |
| 4,606,672 | 8/1986 | Le Sire | 405/99 X |

FOREIGN PATENT DOCUMENTS

| | | |
|---|---|---|
| 148908 | 8/1985 | Japan . |
| 51505 | 3/1988 | Japan . |
| 51506 | 3/1988 | Japan . |
| 653331 | 3/1979 | U.S.S.R. . |

*Primary Examiner*—Randolph A. Reese
*Assistant Examiner*—John Ricci

[57] ABSTRACT

A system and method for cleansing a harbor are disclosed which utilize the natural wave-like surface behavior of a tide wave propagating up a natural harbor or bay. Surface elevation changes along the propagating wave provide hydrostatic pressure differentials which drive the system. The system includes a conduit which connects an open sea area with an inner harbor area. The conduit may be either positioned on the bottom of harbor so that it extends through the harbor bay or it may be positioned so that it cuts across or cuts through a strip of land separating the harbor from the open sea. The conduit inlet is positioned in the open sea area and the conduit outlet is positioned in the inner harbor area. The outlet has a one way valve which both allows water flow through the conduit from the open sea area directly into the inner harbor area and also prevents water flow in the conduit in the reverse direction. The one way valve may be automatically responsive to directional water flow in the conduit, differential tidal water pressures between the open sea area and the inner harbor area, or it may be actuated by a suitable power source.

7 Claims, 5 Drawing Sheets

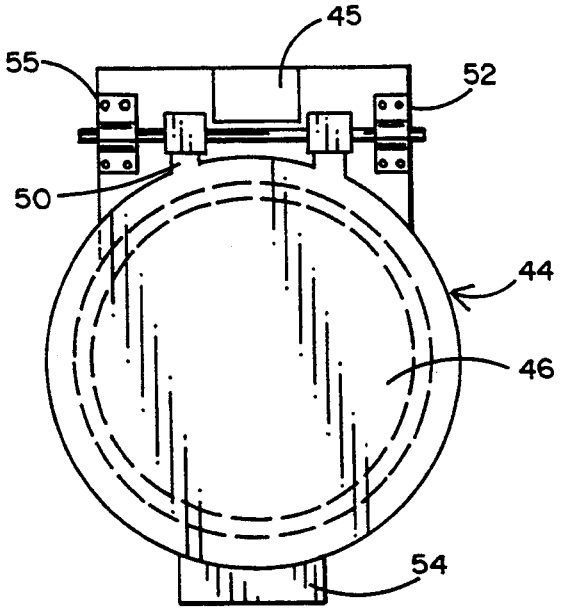
FIG. 7a
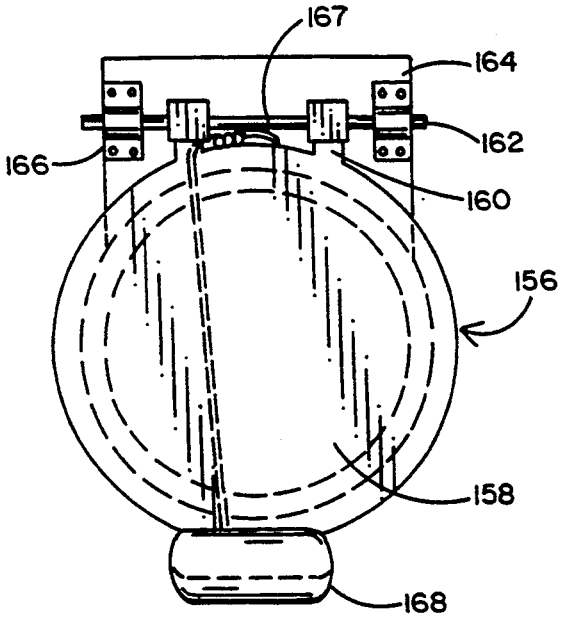
FIG. 8a
FIG. 9a
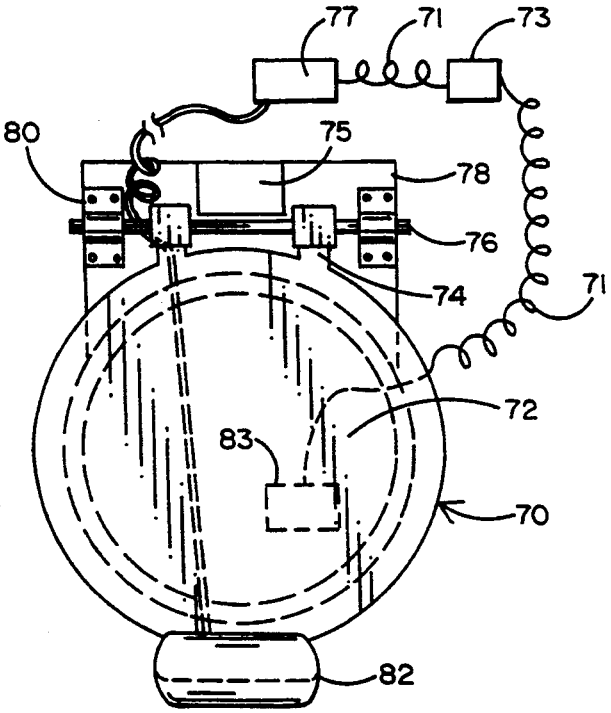

TIDAL SYSTEM AND METHOD FOR CLEANSING A HARBOR

This a continuation of application Ser. No. 07/497,489 filed Mar. 22, 1990, now abandoned.

BACKGROUND OF THE INVENTION

The invention relates generally to systems and methods for cleansing harbors and more particularly to such systems and methods which utilize the forces produced by the tides to flush water through the harbor and thereby remove therefrom harbor contaminants which are suspended or dissolved in the harbor waters or which may be simply carried away by the forces of the water currents. The invention is particularly useful in harbors which do not have a river stream emptying thereinto and which therefore do not have a natural flushing system to cleanse the harbor.

Harbors without a river must rely instead on ocean tide action for cleaning. The effectiveness of the tide in replenishing polluted water is diminished by the absence of any inherent flow of water associated with the tide. In that sense the tide is similar to wind driven waves which manifest only minor flow of water. This minor actual water flow renders the un-modified tide action a poor general cleaning instrument.

Water movement near the harbor inlet moves in and out from the ocean and thus replenishes the inlet with clean water from the ocean. This therefore results in effective cleaning. However, the water substantially inside the inlet is not connected directly with ocean water. This water therefore tends to slosh aimlessly back and forth with the tide without yielding effective cleaning. The waters in the inner areas of the harbor are thus generally stagnant and pollutants consequently tend to accumulate unabated in these areas.

This invention utilizes the natural characteristics of the tide to establish and maintain clean water circulation throughout the entire harbor. This circulation bring clean water directly to the inner harbor, or back harbor, to replace stagnant water.

Consider the phenomenon that is the tide. The tide is caused primarily by cyclic forces provided by the gravitational pull of the moon on the ocean waters. In response to these gravitational forces the water surface seeks to follow the relative position of the moon with respect to the earth. However, the actual forward propagation velocity of the elevation changes is modified by the free velocity of propagation in water in response to external disturbances. This free velocity constitute the propagation velocity of the tide. It is equal to the square root of the product of the acceleration of gravity and the depth of the water.

The combination of cyclic gravitational forces with the free velocity of propagation combine to give the tide a natural, wave-like nature. Thus the tide propagates in the form of a series of crests and troughs similar to wind-driven waves. The wavelength, the distance from crest to crest, of the tide wave is determined by the propagation velocity in water and the lunar period according to well understood physical principles.

The change of surface elevation along the path of propagation resulting from the wave tide wave is a fundamental characteristic of tide behavior. This characteristic provides the fundamental underlying principle supporting this invention. These elevation changes result in corresponding hydrostatic pressure changes in the water along the path of propagation of the tide. A comparison of hydrostatic pressure between diverse points along the path produces a hydrostatic pressure differential, or head.

The instant invention relies on the natural head between points along the path of propagation and implements the invention by connecting a submerged pipe from one point along the propagation path to another. For example, if the pipe connects a tide crest with a through, then water will flow according to well understood hydraulic principles of flow of fluids.

The principle is completely general. Therefore, the invention as described would theoretically function equally well in an open ocean. It needs no artificial abstruction to generate a head; the generated hydraulic head is inherent in the propagation of the tide itself.

In practical terms the wavelength in an open ocean, measured in hundreds of miles, is prohibitively long to implement the invention there. However, in a small boat harbor, or in a wetlands area or bay, the water depths are such that the wavelengths are measured in miles or fractions of miles instead of hundreds of miles. This makes the invention entirely feasible in such a harbor. Therefore the applicant's invention does not need any dam means or artificially created constrictions which impedes shipping in a harbor for the purpose of generating a head.

Some prior art systems use the energy of water currents or waves to cleanse a harbor. An example of such a device is dislcosed in U.S. Pat. No. 833,543 to Parker. The Parker device uses the force of impact or dash of waves against a floating apron. The apron floats so that the top of the apron lies int he water surface. The waves, upon impact, splashes over the top of the apron and into a connecting reservoir behind the apron. The level of water in the reservoir consequently rises to produce a head that is at a wave-determined differential height relative to the sea level at a particular time. This differential head is used to effect flow of fresh sea water into the bay via a connective canal.

The apron of the Parker patent floats with the surface of the ocean water. It therefore also floats with the tide. Consequently, the reservoir behind the apron is independent of the tide. Thus, the Parker invention does not utilize the tide as a head producing agent.

The problem with the Parker patent is that it ignores the effects of tide variances within the bay. This may in fact render the method inoperable as the tide in the bay may be higher than the wave generated head of water.

Other types of prior art devices for cleansing harbors utilize reservoirs to collect waters moved by tidal flow. An example of such a device is disclosed in U.S. Pat. No. 4,162,864 to Maeda. The Maeda device uses one or more reservoirs to collect water brought therein by the tides.

Floodgates are also provided to control water flow into and out of the reservoirs. Appropriate floodgates are opened to release water from the reservoirs into the harbor when the reservoir waters have a head higher than the sea and when the tide has begun to ebb. However, a primary disadvantage with such a system is that construction of such reservoirs may be unreasonably expensive and operation and maintenance of the floodgates may also be inordinately expensive. In addition, the large size and number of the reservoirs take up valuable space in the harbor and may also interfere with normal usage of the harbor.

A harbor cleansing system is thus needed which can effectively flush water from stagnant (or dead water) areas of a harbor. A harbor cleansing system is also needed that is economical and neither requires a lot of harbor space nor interferes with normal harbor usage.

SUMMARY OF THE INVENTION

It is a principal object of the present invention to provide a system and method for cleansing a harbor.

It is another object of the present invention to provide a system and method for flushing stagnant water from a harbor.

It is also another object of the present invention to provide a system and method for cleansing a harbor which utilize tidal water forces.

It is also an object of the present invention to provide a system and method which are capable of flushing water and contaminants from inner areas of a harbor.

It is an object of the present invention to provide a system for cleansing a harbor which is economical to construct and maintain.

It is an object of the present invention to provide a system for cleansing a harbor which requires minimal harbor space.

It is an object of the present invention to provide a system for cleansing a harbor which which is automatic in operation.

It is an object of the present invention to provide a system for cleansing a harbor which is simple in construction and operation to provide long life and trouble-free performance.

The harbor cleansing system and method of the present invention is specifically designed to provide a simplified structure for directing fresh sea water to inner areas of a harbor in order to flush contaminants out of the harbor through the harbor bay. The system includes a conduit which connects an open sea area to a desired area of the harbor.

The natural phenomena underlying this invention is based on two physical principles, a first principle characterizing tide propagation in a bay or harbor and a second principle defining flow behavior of an incompressible fluid in an enclosed pipe or conduit.

The first principle of the tide lies in the cyclic, gravitational pull exerted on the ocean waters. The moon is the primary source of the pull. The response to these gravitational forces is water elevation changes in the ocean. The actual forward propagation velocity of these elevation changes follow the free velocity of propagation of disturbances in water. This free velocity is equal to the square root of the product of the acceleration of gravity and the depth of the water.

The cyclic actuating forces and independent propagation velocity combine to give the tide its natural, wave-like character. The tide, and surface elevation changes, therefore propagates in the form of a series of crests and troughs similar to wind-driven waves.

The important aspect of tide behavior, as it pertains to this invention, is the change of surfaces elevation along the path of propagation. These elevation changes then result in results in varying hydrostatic pressures along the path of propagation. Between two separate points along the path these pressure changes result in a hydrostatic differential pressure, or head. The actual head varies with the tide cycle.

The separate points may lie anywhere along the path of propagation. For example, one point may be in the ocean and another in the inner harbor, or back bay. The actual head varies cyclically with the tide cycle. Sometimes the ocean water level is higher than the level in the inner harbor sometimes the inner harbor water level is the higher.

The second principle relates to an enclosed conduit having two open ends that is filled with an incompressible fluid. The principle states that the pressure differential between an open end of the conduit and the opposite end of the same conduit will manifest instantaneously at any point in the fluid within the conduit. The manifestation of this pressure differential will be in the form of fluid pressure, fluid flow rate or a combination of the two. The effect on the fluid in the conduit is that, with a pressure differential between the open ends, the fluid starts to flow with a flow rate proportional to the pressure differential. Because the fluid is incompressible, its acts as a horizontal, rigid column within the conduit, wherein a higher pressure at one end "pushes" the column to expel the water located at the other end. Thus, start of flow at the low pressure end of the conduit is instantaneous.

The effect of the first principle is for example to create a head between the open ocean and the inner bay or harbor. When connecting the ocean to the inner harbor with an enclosed conduit, then the effect of the second principle is to instantaneously apply the head at the ocean end of the conduit to the harbor end. This head at the bay will manifest initially as a pressure differential that will translate into water flow according to well understood hydraulic principles.

An additional consideration relates to the length of the conduit and resulting similarity of the flow in the conduit with that of the bay. When the conduit is long, the water within the conduit will suffer the same fate as the tidal water in the bay and will aimlessly slosh back and forth within the conduit without replenishing the water of the inner harbor. This situation is corrected by including a one-way valve in the conduit. This insures a one-way flow in the conduit. Return water must now flow through the harbor itself. This provides circulation of the overall harbor system and replenishment of polluted water with clean ocean water.

Three general elements are nominally required in order to take advantage of the physical principles and considerations delineated above and thereby obtain instantaneous and clean sea water flow between the ocean and the inner harbor to clean the harbor:

First: an enclosed, submerged conduit connecting the open ocean to the inner harbor, thus bridging the hydrostatic pressure differential;

Second: timing means to determine the presence of a desired head; and

Third: controls within the conduit to maintain a unidirectional flow, preferably in a direction from the ocean into the inner harbor.

The timing means must disclose the occurrence of a relevant head that is favorable to effect a desired flow. However, acknowledging that the head manifests as a pressure differential, then the timing means may be served equally well by means for sensing the comparable pressure differential in the conduit.

The control means must limit water flow to one direction, preferable from the ocean into the inner harbor, and thereby insure that the system brings a continuous flow of clean water that is effective in flushing the harbor.

In a first and second embodiment, the conduit is closed at its sides while open at its inlet and outlet ends and may thus be in the form of a pipe or tube. The pipe as well as the inlet and outlet ends, must be completely submerged preferably below low tide water levels. During the time when the open sea area approaches and attains high tide levels, the open sea water level is higher than the harbor water level. This difference in water levels at the inlet and outlet results in a water pressure differential between the inlet and outlet of the enclosed conduit which causes water to flow from the open sea area to the harbor area though the conduit. However, in order to maintain water flow through the conduit, the entire conduit must be submerged below at least the high tide level. But, if the conduit is positioned so that it is instead completely submerged below low tide water levels, the conduit will be completely filled with water at all times. Consequently, since, in this position, the conduit is completely filled with water at all times, water flow therethrough resulting from differential tidal water pressures will be instantaneous. This is because the force produced by the differential water pressure will be transmitted instantaneously through the conduit due to the incompressibility of water. This instantaneous flow of water into stagnant water areas of the harbor is a marked improvement over prior art harbor cleansing systems which do not anticipate the complex propagation of the tide water into harbor areas.

The first and second embodiments may be provided with a means for both allowing water flow out of the open sea through the conduit and into the harbor as well as preventing water flow out of the harbor through the conduit and into the open sea. This may simply be a one way valve whose function is to time the flow of water according to the tide and whose structure is a lid mechanism having a neutrally buoyant lid. Since the differential water pressures are transmitted directly through the water in the conduit, this pressure will serve as a timing mechanism. Thus, the differential water pressure acting against such a neutrally buoyant lid pushes the lid open allowing water flow out of the outlet. The kinetic energy of the water flowing through the outlet exerts a force on the lid thereby keeping it open. The lid also closes under the force exerted thereon by water flowing in the reverse direction (i.e., water attempting to reenter the outlet of the conduit and travel therethrough into the open sea area) and swirling around the lid. Thus, the neutrally buoyant lid also prevents water from flowing out of the harbor through the conduit thereby requiring "dirty" water to flow out of the harbor through the harbor bay. Preventing reverse flow of water through the conduit also prevents contaminants such as sludge from building up inside the conduit and clogging the conduit. When the tide is incoming, the valve or lid opens to allow fresh sea water to enter the inner harbor; when the tide is outgoing and water at the conduit outlet starts to flow in a reverse direction through the conduit, the valve or lid closes forcing the stagnant water to flow out the harbor bay to the sea thereby allowing the fresh sea water to flush out the inner harbor. The process is continuous with the tidal cycle maintaining a generally continuous and substantial replacement of inner harbor waters. Thus, the lid mechanism is automatically actuated by tidal water forces resulting in automatic control of the water flow through the conduit. Alternatively, however, the lid mechanism may also be actuated by an external power source such as a compressor or an electric motor.

Instead of always utilizing an enclosed conduit, there are circumstances where an open trench is sufficient. Such a circumstance is presented by a situation wherein a bay is separated from the ocean by only a narrow strip of land. In this case the tide must again propagate from the entrance of the harbor to the inner harbor at a given velocity. Similarly, the tide must also propagate along the open trench, but at a velocity determined by the characteristics of the trench.

When the trench is short relative to the length of the bay there exists a difference in water levels at the exit of the trench in the inner harbor and the level of the water in inner harbor itself. This creates a time varying head whose time cycle is dependent on the underlying tide cycle and the differing length and depths of the bay and of the trench. It is readily determined. By implementing timing means reflecting the variable head, the flow in the trench may be controlled to insure that the flow is uni-directional; for example, from the ocean into the inner harbor, or back harbor.

Instead of utilizing a one way valve or functionally similar structure, the conduit may be completely open at both ends. Such an open ended conduit may be desirable if the particular characteristics of the harbor in which it is utilized would make the conduit effective in carrying contaminated water out of the harbor as well as carrying fresh water into the harbor. For example, if the conduit inner diameter is relatively large (or there are multiple conduits) and the conduit is relatively short (such as if it crosses a narrow strip of land or breakwater), the conduit may be able to carry sufficiently large quantities of water therethrough to make it effective to also remove contaminants.

In a third embodiment, the conduit is a trench which is open at its upper portion. The trench is positioned at depths so that the combination of tidal head of the ocean relative to the bay and of flow characteristics of the trench causes water to through the trench from the open sea area directly into the inner harbor. The difference in water levels between the open sea area at the inlet of the trench and the inner harbor area at the outlet of the trench permit the forces of gravity acting on the (higher) open sea area water to cause water to flow through the trench into the inner harbor area.

The trench may also be provided with a means for controlling flow of water through the trench. According to the tidal cycle this may simply be a one way valve or a hinged lid mechanism having a neutrally buoyant lid or a lid having an air chamber to enable water flow through the trench (or low tidal water levels in the inner harbor area) to actuate the lid and allow water to flow out of the outlet into the inner harbor. In the same way water flow in the reverse direction exerts a force against the lid (or lid buoyancy produced by high tidal water levels in the inner harbor area) to close it and thereby prevent reverse flow of water through the trench which forces stagnant water in the inner harbor to flow out through the harbor bay. The combination of fresh water flowing into the harbor through the trench and stagnant water flowing out of the harbor through the harbor bay produces circulation which will cleanse the harbor. Additionally, preventing reverse flow of water through the trench prevents contaminant buildup therein (from inner harbor waters) and clogging of the trench. However, the trench need not be provided with a means for preventing reverse flow if it is deemed that the trench may effectively assist in also carrying contaminated water out of the harbor without significant risk of clogging the trench. For example, if the trench is short, it need not be provided with a means for preventing reverse water flow. The process is continuous with the tidal cycle maintaining a generally continuous replacement of inner harbor waters.

It is an important feature of the invention that the outlet of the conduit may be positioned anywhere in the harbor where the flushing action of the system of the present invention is needed to cleanse stagnant harbor waters. Thus, although it is generally preferable to have the outlet placed in the innermost areas of the harbor where typically the most contaminated stagnant waters are to be found, the outlet may be positioned anywhere in the harbor where it may be deemed most effective in cleansing stagnant water areas of the harbor. It is also an important feature of the invention that the direction of controlled flow may be oriented in an outward direction. Thus, where a bay is particularly polluted by an open sewer, the conduit may empty waste products into the ocean and receive fresh water from the normal flow through the mouth of the bay.

It is further an important feature of the invention that a multiplicity of conduits may be used and that separate conduits may then operate in opposite directions to further the more efficient flushing of the bay.

The system and method of the present invention have particular application in those harbors which do not have a river emptying thereinto providing natural cleansing of the harbor. In addition, the system of the present invention is simple in construction and simple in operation thereby rendering it inexpensive to build, maintain and operate.

BRIEF DESCRIPTION OF THE DRAWINGS

FIG. 7*a* is a front plan view of a first lid mechanism connected to the conduit of the first embodiment preventing reverse flow of water through the conduit.

FIG. 8*a* is a front plan view of a second lid mechanism connected to the conduit of the first embodiment preventing reverse flow of water through the conduit and having variable volume air bags.

FIG. 9*a* is a front plan view of a third lid mechanism connected to the conduit of the first embodiment for preventing reverse flow of water through the conduit and having a compressor connected to a variable volume air bag.

DETAILED DESCRIPTION OF THE PREFERRED EMBODIMENT

Figure 1:
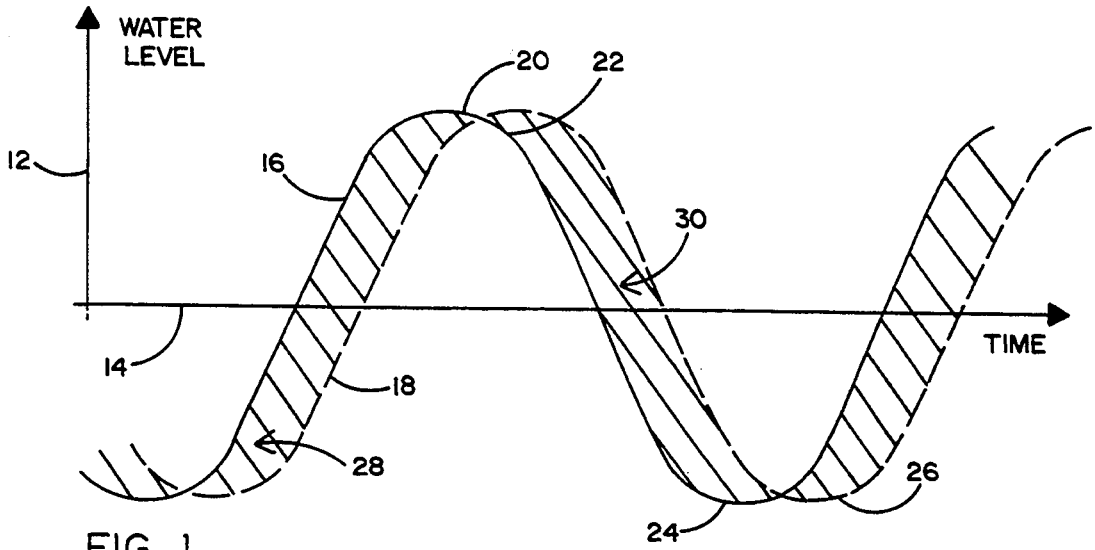
FIG. 1 is a graphical diagram of the water levels of a representative inner harbor area and a representative proximal open sea area illustrating their time phase relationship.

Referring to the drawings, FIG. 1 is a graph showing the time phase relationship of the water levels in a representative inner harbor area and a representative open sea area. The ordinate 12 represents water level, and the abscissa 14 represents time. The curve 16 in the graph of FIG. 1 represents the tidal water levels in the open sea area, and the curve 18 represents the tidal water levels in the inner harbor area. Curves 16 and 18 are generally sine waves. The open sea area reaches high tide water levels at time 20 and low tide water levels at time 24, while the inner harbor area reaches high tide water levels at a later time 22 and low tide water levels at a later time 26. The area 28 between the curves 16 and 18 shows the time lag, between the inner harbor and the open sea areas in moving from low tide to high tide water levels. During this first time lag period of area 28, the open sea water levels are higher than the inner harbor water levels. This time lag between the inner harbor and open sea areas creates a pressure differential and is a first principle that is used in the development of the present invention. Conversely, the area 30 between the curves 16 and 18 shows the time lag between the inner harbor and open sea areas in moving from high tide to low tide water levels. During this second time lag period of area 30, the open sea water levels are lower than the inner harbor water levels.

Figure 2:
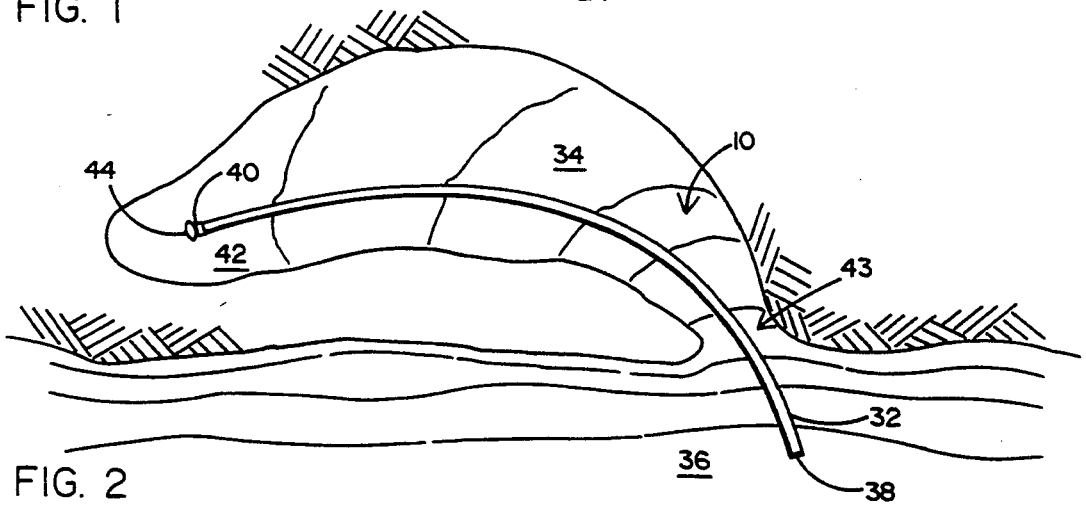
FIG. 2 is a top plan view of a first embodiment of the present invention showing a conduit submerged under the water in the harbor, bay and open sea.

FIG. 2 shows a first embodiment of the invention generally designated by the numeral 10. Embodiment 10 includes a conduit 32 positioned in a harbor 34 and an open sea area 36. Conduit 32 preferably extends through the bay 43 of the harbor 34. Conduit 32 is preferably closed on its upper, lower and lateral sides and is in the form of a generally tubular pipe with a generally circular cross-section although it could also have any other suitable cross-sectional shape. Conduit 32 also preferably has an inlet 38 located in the open sea area 36 and an outlet 40 located in an inner harbor area 42. Inlet 38 and outlet 40 are preferably submerged below the low tide water levels of the open sea area 36 and inner harbor area 42, respectively. In addition, inlet 38 is preferably submerged at a depth sufficient to allow it to avoid the adverse effects of waves and surface currents caused by storms, weather conditions etc. Conduit 32 is also preferably entirely submerged to a depth at which it is entirely below at least the high tide water levels (or preferably low tide water levels) of the open sea area 36 and inner harbor area 42. Moreover, inlet 38 and outlet 40 are preferably submerged at approximately the same depth relative to low tide or high tide levels in the inner harbor or open sea areas.

Submerging the inlet 38 and outlet 40 ends as well as the conduit 32 allows water pressure differential between the open sea area and the inner harbor area to effectuate water flow therebetween. Because of the time lag between rising tide (and high tide) in the open sea area 36 and rising tide (and high tide) in the inner harbor area 40, during the time period represented by area 28 in FIG. 1 water levels in the sea area 36 are higher than the inner harbor area 40. Due to this difference in water levels, there is a tidal water pressure differential between the inner harbor area 40 and the open sea area 36 at the same depth or level relative to the same reference location or standard (such as relative to the center of the earth or relative to the low tide level in the inner harbor area 42). Consequently, since the inlet 38 and outlet 40 are submerged at approximately this same level, during the time period represented by area 28 the water pressure differential will cause water to flow from the open sea area 36 through the conduit 32 and into the inner harbor area 42. Because water is an incompressible fluid, the flow begins instantaneously. In addition, the entire conduit 32 is submerged to a depth sufficient to allow it to be completely filled with water when water flow therethrough is desired.

Figure 7B:
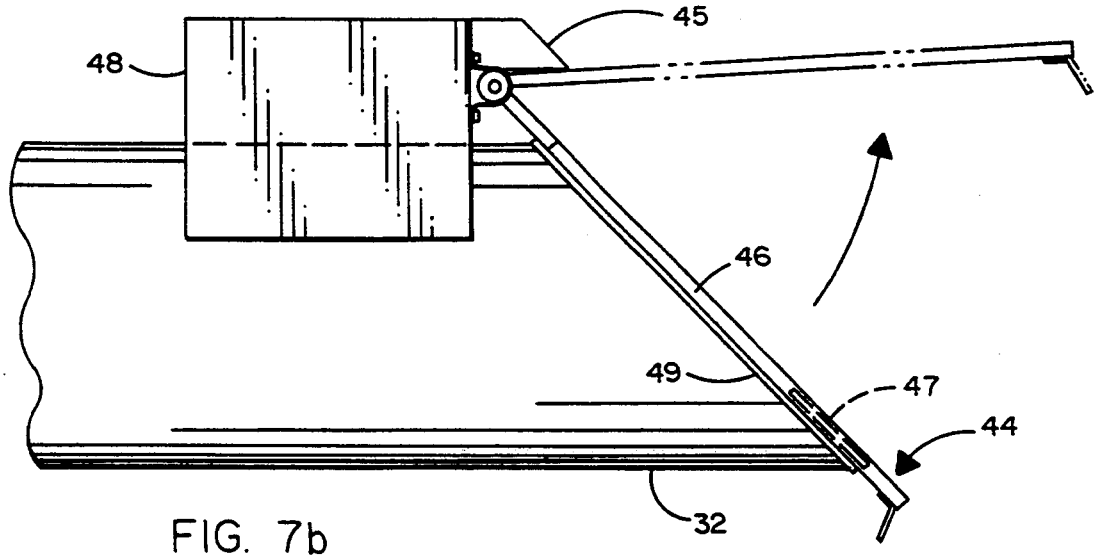
FIG. 7*b* is a side plan view of the first lid mechanism shown in FIG. 7*a*.

Conduit 32 also preferably is provided with timing means which will open and close the conduit 32 according to the timing of the tide pressure differentials as shown in FIG. 1, and thus allow water to flow only into the inner harbor area 40. However, since the pressure differential between the open sea area 36 and the inner harbor area 40 manifest at the end of the conduit 32, then it is preferred to employ a one way valve, lid mechanism or other suitable means for preventing water from flowing out of the inner harbor area 42 and into the open sea area 36 via conduit 32 when the water level in the inner harbor area 42 is higher than the water level in the open sea area 36 (during the time period represented by the area 30 in FIG. 1). A first lid mechanism 44 has a lid 46 which is hingedly attached to a base 48 mounted on the conduit 32 (FIG. 7*b*). Lid mechanism 44 provides preferably timing or sensing means synchronized to the tide for opening and closing of the lid 46 (and outlet 40). Outlet 40 is preferably slanted to facilitate water flow out of the outlet 40 by reducing the angle of lid rotation needed to fully open the outlet 40. The structure and function of lid mechanism 44 will be described in detail hereinbelow.

Figure 3:
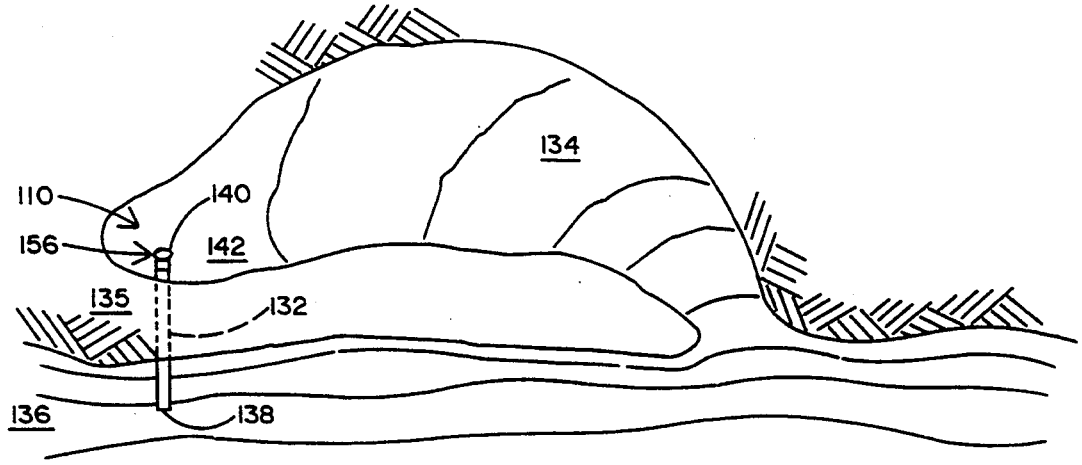
FIG. 3 is a top plan view of a second embodiment of the present invention showing a conduit partially embedded in a strip of land separating the harbor from an open sea area.
Figure 4:
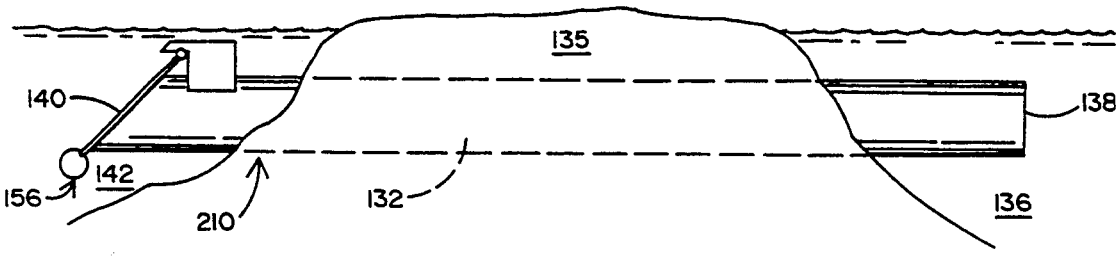
FIG. 4 is a longitudinal sectional view of the second embodiment illustrated in FIG. 3 showing the postioning of the conduit in relation to the water levels of the inner harbor area and the open sea area.

FIGS. 3 and 4 depict a second embodiment 110 of the invention having a conduit 132 with an inlet 138 placed in an open sea area 136 and an outlet 140 placed in an inner harbor area 142. However, conduit 132 is partly embedded in a narrow strip of land 135 which separates the inner harbor area 142 from the open sea area 136. Conduit 132 is preferably closed on its upper, lower and lateral sides so that it is generally in the form of a pipe or tube with a generally circular cross-section. Inlet 138 and outlet 140 are preferably submerged below low tide water levels to provide water flow therethrough under differential tidal water pressures. The conduit 132 is also preferably entirely below the low tide water levels or at least high tide water levels so that it is completely filled with water when water flow therethrough is desired. In addition, the inlet 138 is preferably submerged at a depth sufficient to allow it to avoid the adverse effects of waves or surface currents caused by storms, weather conditions etc. In all other respects, the structure and function of embodiment 110 are identical to those of embodiment 10 which have been described hereinabove so they will not be repeated.

Embodiment 110 preferably also has a one way valve or second lid mechanism 156 at outlet 140 to control water flow through conduit 132. Outlet 140 is preferably slanted to minimize lid rotation needed to fully open outlet 140. Lid mechanism 156 will be described in detail hereinbelow.

Figure 5:
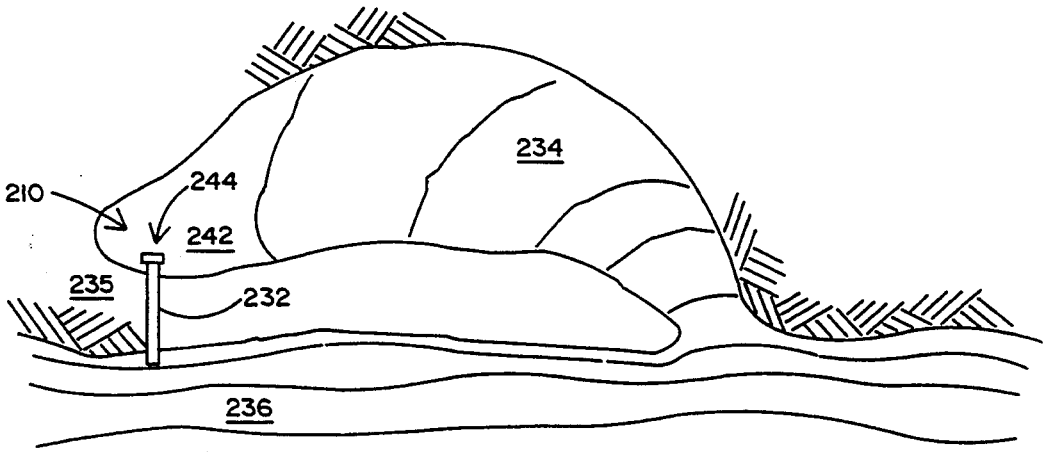
FIG. 5 is a top plan view of a third embodiment of the present invention showing a trench laid across a strip of land separating the harbor from an open sea area.
Figure 6:
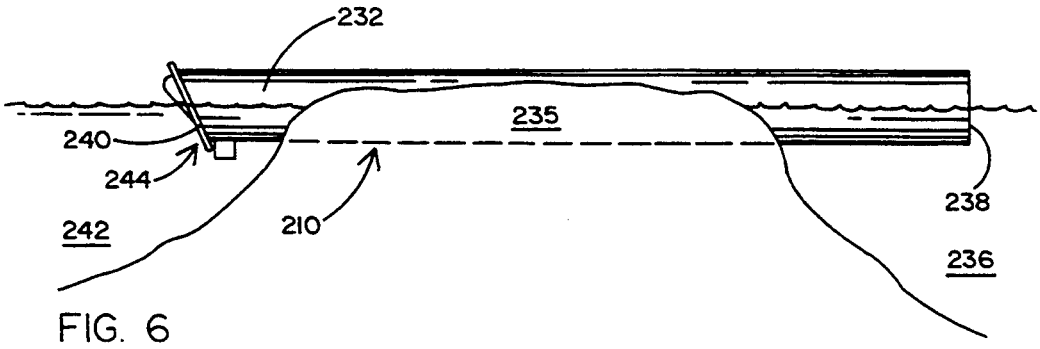
FIG. 6 is a longitudinal sectional view of the third embodiment illustrated in FIG. 5 showing the positioning of the trench in relation to the water levels of the inner harbor area and the open sea area.

FIGS. 5 and 6 depict a third embodiment 210 of the invention. Embodiment 210 includes a trench 232 which is positioned in a strip of land 235. Trench 232 is provided with an inlet 238 placed in the open sea area 236 and an outlet 240 placed in the inner harbor area 242 so that trench 232 connects the open sea area 236 with the inner harbor area 242. Inlet 238 and outlet 240 are preferably positioned at or below low tide water levels. Consequently, tidal water forces produced by the incoming tides will cause water to flow from the open sea area 236 through the trench 232 and into the inner harbor area 240. In addition, the relative levels of the inlet 238 and outlet 240 may be altered from the foregoing positions, if desired, in order to change the cycles of water flow through the trench 232. However, in contrast to the first and second embodiments, water does not flow in trench 232 solely due to a water pressure differential because the trench 232 is not entirely submerged and is not closed on all sides as are conduits 32 and 132. Instead, water generally flows through trench 232 due to both water pressure differential and to the forces of gravity acting on the difference in water levels between the open sea area 236 and the inner harbor area 242 as a result of difference in tidal ebb and flow through the harbor to the inner harbor area 242 and through the channel 232 to the outlet 240. In all other respects, the structure and function of embodiment 210 are comparable to those of embodiments 10 and 110 which have been described hereinabove so they will not be repeated.

Embodiment 210 is preferably provided with a one way valve or a lid mechanism 244 at outlet 240 to control water flow through trench. Outlet 240 is preferably slanted to minimize lid rotation needed to fully open outlet 240. Lid mechanism 244 will be described in detail hereinbelow.

The first lid mechanism 44 is depicted in detail in FIGS. 7*a* and 7*b*. Lid mechanism 44 has a lid 46 with a base 48, a pair of hinge members 50 and a hinge pin 52 rotatably connected to the base 48 preferably by means of bearings 55. The base 48 is preferably secured to the conduit 32. A tab 54 is secured to the lid 46 so that water flowing in a reverse direction (i.e., into the outlet 40 through the conduit 32 and out of the inlet 38) pushes the lid 46 (and outlet 40) into a closed position and also acts as a trim tab to hold the lid 46 in a fully open position when water flows through the conduit 32 into the inner harbor area 42.

The lid 46 is preferably composed of a neutrally buoyant material or has a chamber 47 therein (or attached thereto) that is filled with air in order to give the lid a desired neutral buoyancy to reduce the degree of force needed to open and close the lid. Consequently, the lid 46 can be pushed open more easily under the tidal differential water pressure exerted thereon, and, conversely, it may also be pushed closed more easily by reverse water flow acting on the tab 54. Thus, water pressure and water flow acting on components of the lid mechanism 44 automatically open and close the lid 46 so as to automatically control water flow through the conduit 32 in synchronization with the tidal cycle. Lid 46 (or outlet 40) is preferably provided with a seal 49 which may be composed of rubber or a soft metal such as copper or aluminum or any other suitable sealing material or compound to enable seal 49 to prevent leakage of water between the lid 46 and conduit 32. Although described and depicted in conjunction with embodiment 10, lid mechanism 44 may be incorporated in the second embodiment 110 and third embodiment 210 as well.

Although the lid mechanism 44 is shown as connected to the outlet 40 of the conduit 32, it may also be connected to the inlet 38 of the conduit 32 or to any suitable part of the conduit 32. In addition, there may also be a foundation (not shown) mounted in the bottom of the inner harbor area and secured to the base 48 to more firmly secure the lid mechanism 44 and outlet 40.

Figure 8B:
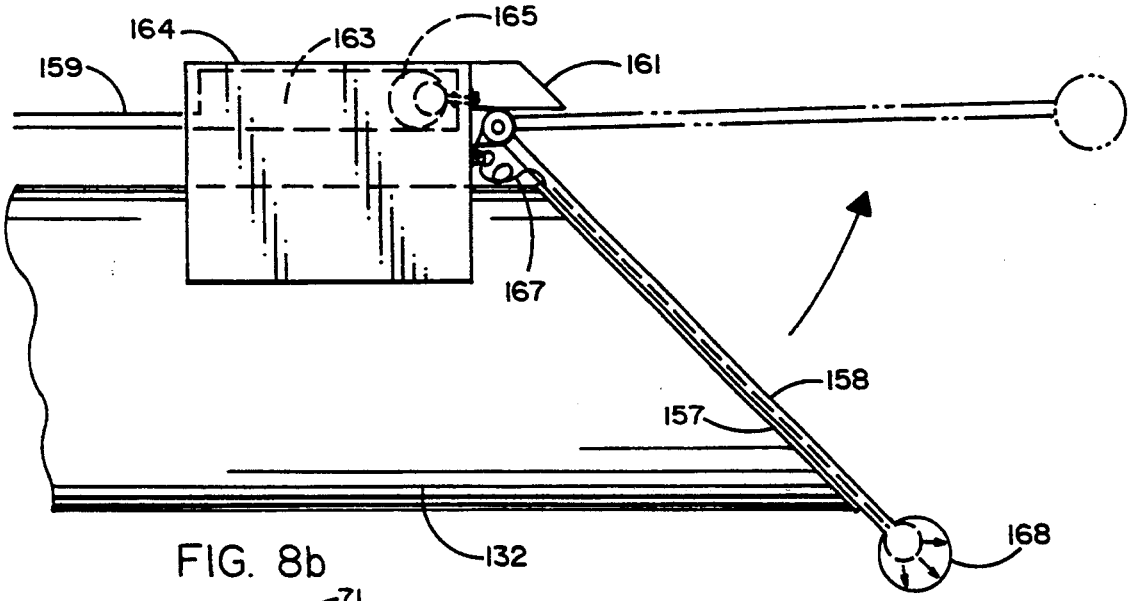
FIG. 8*b* is a side plan view of the second lid mechanism shown in FIG. 8*a*.

The second lid mechanism 156 is shown in detail in FIGS. 8*a* and 8*b*. Lid mechanism 156 has an automatic buoyancy system which includes a chamber 163 In the base 164, an inflatable bag 165 in the chamber 163 and a lower inflatable bag 168 mounted on the lid 158. Chamber 163 is sealed except for a water line 159 connecting the chamber 163 to the open sea area 136. Thus, an increase in water pressure in the open sea area 136 due to rising tide is transmitted to the chamber 164 deflating the bag 165 and forcing the air therein into line 167 and into lower bag 168 thereby inflating bag 168. Inflation of bag 168 increases the buoyancy of lid 158 causing lid 158 to open allowing water from the open sea area 136 to flow out of the conduit 132 and outlet 140 and into the inner harbor area 142. Conversely, when the water pressure in the inner harbor area 142 is greater than the water pressure in the open sea area 136 due to tidal ebb in the open sea area 136, bag 168 is deflated and air therein is forced into line 167 and into bag 165. This reduces the buoyancy of the lid 158 causing the lid 158 (and outlet 140) to close thereby preventing water flow out of the inner harbor area 142 and into the open sea area 136 via conduit 132. Thus, differential water pressures automatically actuate lid mechanism 156 to automatically control water flow through conduit 132. Lid 158 (or outlet 140) is preferably provided with a seal 157 which may be composed of rubber or a soft metal such as copper or aluminum or any other suitable sealing material to enable seal 157 to prevent leakage of water between the lid 158 and conduit 132.

Figure 9B:
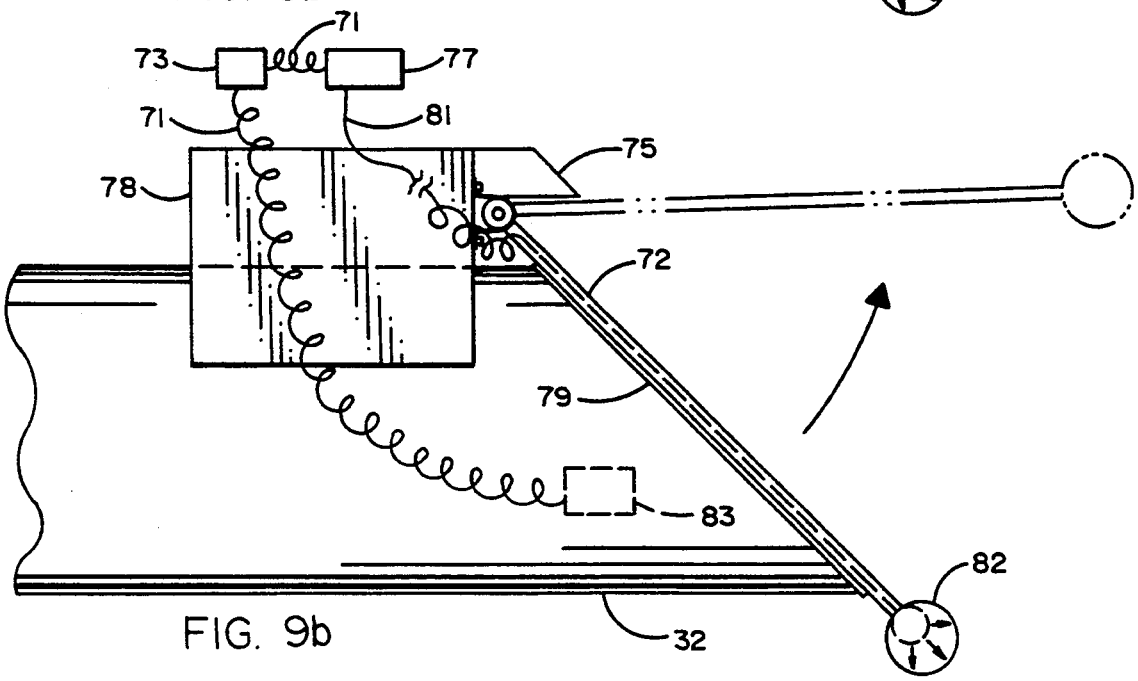
FIG. 9*b* is a side plan view of the third lid mechanism shown in FIG. 9*a*.

FIGS. 9*a* and 9*b* depict a third lid mechanism 70 having a lid 72, hinge members 74 and hinge pin 76. Pin 76 is rotatably connected to base 78 preferably by means of bearings 80. The base 78 is preferably connected to the conduit 32 or other suitable foundational structure in the harbor 34. Lid mechanism 70 is also preferably provided with an inflatable bag 82 at the lower portion of the lid 72. A suitable line 81 connects the bag 82 to a compressor 77 preferably located above the water and preferably on a suitable firm foundational structure (not shown) in the harbor 34. Thus, the compressor inflates bag 82 via line 81 which makes the lid 72 positively buoyant resulting in the lid rising to thereby open the outlet 40. Lid 72 (or outlet 40) is preferably provided with a seal 79 which may be composed of rubber or a soft metal such as copper or aluminum or any other suitable sealing material to enable seal 79 to prevent leakage of water between the lid 72 and conduit 32.

Lid mechanism 70 is also provided with a sensor 83 to monitor tidal water pressure changes and a control unit 73 to control the compressor 77 in response to sensor output. Sensor 83 is preferably mounted in the conduit 32 preferably proximal the outlet 40. Optionally, sensor 73 may be positioned proximal the inlet 38 or at any suitable location in the open sea area or in the inner harbor area. Sensor 83 may also be a plurality of sensors located at suitable locations to measure the pressure differentials of the tidal water cycles.

Sensor 83 monitors the pressure of the water in the conduit 32 due to tidal flow and ebb. Sensor 83 responds to an increase in water pressure in the conduit 32 produced by the incoming tide and transmits a corresponding signal to control unit 73. In response, control unit 73 transmits an electrical current to compressor 77 to pump air into lower air bag 82 via line 81 thereby giving lid 72 a positive buoyancy and opening the same. Thus, water is allowed to flow from the open sea area 36 into the inner harbor area 42 via conduit 32. When the tide is outgoing and the sensor 83 senses that the water pressure in the conduit 32 is no longer increasing (or when it senses the water pressure therein is decreasing), it transmits a corresponding signal to control unit 73 which, in response, transmits an electrical current to compressor 77 to reduce the air pressure in the line 81 (and bag 82) to thereby decrease the buoyancy of the lid 72 and close the same. Consequently, the water in the inner harbor area 42 will flow through the bay 43 and into the open sea area 36 thereby removing stagnant water and harbor contaminants from the harbor 34.

Figure 10A:
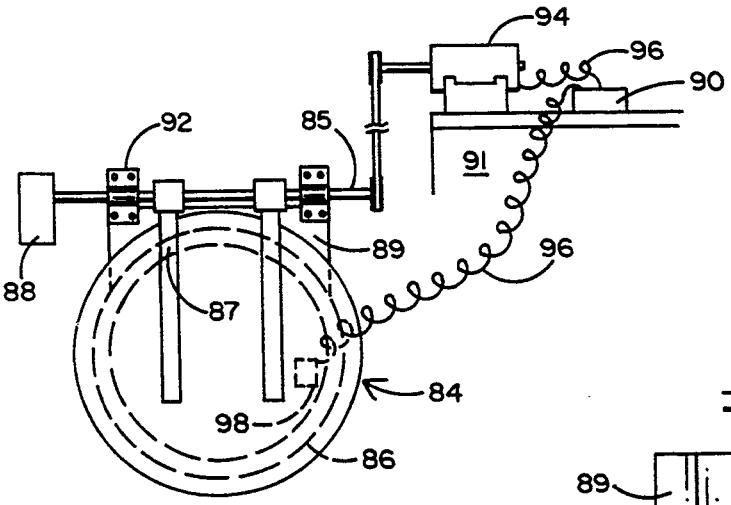
FIG. 10*a* is a front plan view of a fourth lid mechanism connected to the conduit of the second embodiment for preventing reverse flow of water through the conduit and having a motor for actuating the lid .
Figure 10B:
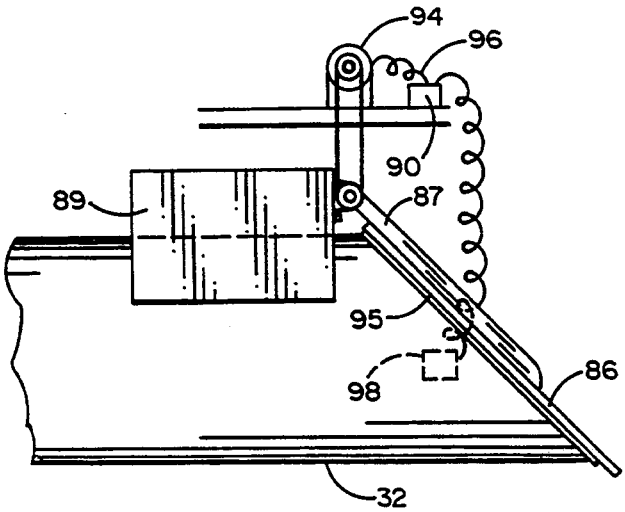
FIG. 10*b* is a side plan view of the fourth lid mechanism shown in FIG. 10*a*.

FIGS. 10*a* and 10*b* illustrate a fourth type of lid mechanism 84. Lid mechanism 84 includes a lid 86, a hinge pin 85 rotatably connected to a base 89 by means of beatings 92, and hinge members 87 interconnecting the lid 86 and the hinge pin 85. The base 89 is preferably secured to the conduit 32 although it may also additionally be secured to a foundational structure (not shown) in the harbor 34. Counterweights 88 secured to pin 85 are also provided to reduce the amount of force required to open and close the lid 86. However, counterweights 88 may also be omitted from the lid mechanism 84 in favor of a neutrally buoyant lid, if desired. A motor 94 (preferably electric) is also provided and operably connected (by means of suitable gears) to the lid mechanism 84, as shown. Motor 94 is also preferably mounted on a foundational structure 91 in the harbor 34. A sensor 98 is communicatingly connected to a control unit 90 (or to motor 94) by wires 96. Sensor 98 is preferably mounted in the conduit 32 preferably proximal the outlet 40. Optionally, sensor 98 may be positioned proximal the inlet 38 or at any suitable location in the open sea area 36 or in the inner harbor area 42. In addition, sensor 98 may also be a plurality of sensors located at suitable locations to measure the pressure differentials of the tidal cycles.

Sensor 98 monitors the pressure in the water in the conduit 32 due to tidal flow and ebb. Sensor 98 responds to an increase in water pressure in the conduit 32 produced by the incoming tide and transmits a corresponding signal to control unit 90. In response, control unit 90 transmits an electrical current to motor 94 to actuate the lid mechanism 84 and thereby open the lid 86. Thus, water is allowed to flow from the open sea area 36 through the conduit 32 into the inner harbor area 42. When the tide is outgoing and the sensor 98 senses that the water pressure in the conduit 32 is no longer increasing (or when it senses the water pressure therein is decreasing), it transmits a corresponding signal to control unit 90 which, in response, transmits an electrical current to motor 94 to close lid 86 by actuation of lid mechanism 84. Consequently, the water in the inner harbor area 42 will flow through the bay and into the open sea area thereby removing stagnant water and harbor contaminants from the harbor 34.

Selection of the amount of weight provided on the counterweights 88 and/or the distance of the counterweights from the pin 85 (or from the axis of the lid mechanism 84) allows selection of the degree of force required to open or close the lid 86. Alternatively, the counterweights 88 may instead be chambers (or bags) filled with air and positioned to give the lid 86 a neutral buoyancy thereby reducing the degree of force required to open and/or close the lid 86 and outlet 40. Counterweights 88 may also be provided on the other lid mechanisms described hereinabove to allow the direction and degree of force of water flow against the lids to automatically open and/or close the conduit 32 and thereby allow water flow therethrough from the open sea area into the inner harbor area 42 and prevent water flow therethrough from the inner harbor area 42 into the open sea area 36. Lid 86 (or outlet 40) is preferably provided with a seal 95 which may be composed of rubber or a soft metal such as copper or aluminum or any other suitable sealing material to enable seal 95 to prevent leakage of water between the lid 86 and conduit 32.

The upper portions of the hinge members 87, hinge pin 85, the upper portion of the base 89 and the counterweight 88 are preferably above the high tide water level of the inner harbor area 42 (or alternatively above the low tide water level of the inner harbor area 42). Since these corrosion sensitive parts of lid mechanism 84 are out of the water, they are not as susceptible to corrosion (and binding due to contamination of the moving parts) as lid mechanisms 44, 156 and 70 which are generally submerged in the inner harbor area 42 waters. Consequently, placing these components out of the water extends the operational life and troublefree performance of lid mechanism 84 (and conduit 32).

Figure 11B:
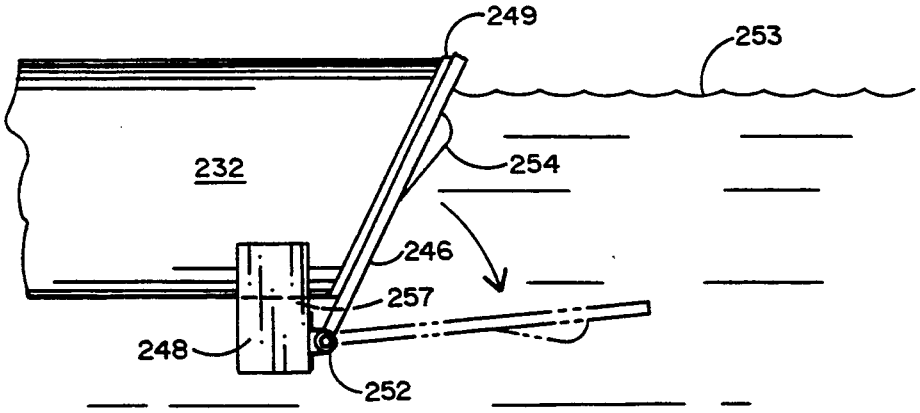
FIG. 11*b* is a side plan view of the fifth lid mechanism shown in FIG. 11*a*.
Figure 11A:
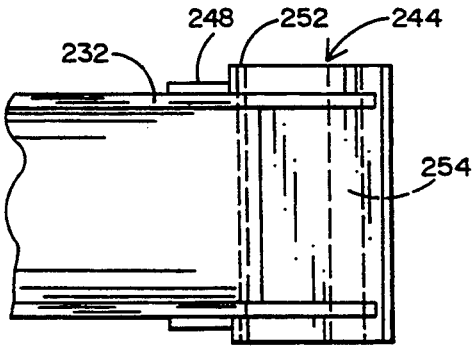
FIG. 11*a* is a top plan view of a fifth lid mechanism connected to the trench of the third embodiment for preventing reverse flow of water through the trench.

FIGS. 11*a* and 11*b* illustrate a fifth lid mechanism 244 adapted for use with the channel 232. Lid mechanism 244 (or another suitable type of one way valve) prevents reverse flow of water through channel 232 in order to preclude water from flowing out of the inner harbor area 242 through channel 232 and into the open sea area 236. Lid mechanism 244 preferably includes a lid 246 secured to a hinge pin 252 which is rotatably mounted on a base 248. The base 248 is preferably mounted on channel 232 or on a foundational structure (not shown) on the strip of land 235 or in the harbor 234. Lid 246 (or outlet 240) is preferably provided with a seal 249 which may be composed of rubber or a soft metal such as copper or aluminum or any other suitable sealing compound to enable seal 249 to prevent leakage of water between the lid 246 and channel 232.

Lid mechanism 244 is also provided with a flotation bag or chamber 254. Flotation bag 254 is preferably mounted on an outer surface of the lid 246 and preferably filled with air. Bag 254 is sufficiently large to give lid 246 (together with bag 254) a neutral buoyancy when at a high tide water level 253. This neutral buoyancy effectively results in generally automatic opening and closing of the lid 246 and outlet 240 as with the other lid mechanisms described hereinabove when the incoming tide has filled the inner harbor area 242 to desired water levels. Thus, water in the inner harbor area 242 must flow out through the harbor bay 243. The bag 254 may optionally be inflated and deflated by an external source of air (not shown) so that inflation of the bag 254 will result in closure of outlet 240 and deflation of the bag 254 will result in opening of outlet 240 in order to provide more control over the opening and closing of the lid 246 and outlet 240.

When the inner harbor area 242 is at low tide water levels and the incoming tide causes water to flow in the trench 232, the flotation bag 254 will be above water resulting in the weight of the lid (or the force of the water flow against the lid 246) causing the lid 246 and outlet 240 to open. Thus, operation of lid mechanism 244 is automatic and effectively allows water flow from the open sea area 236 into the inner harbor area 242 via channel 232 while preventing water flow from the inner harbor area 242 into the open sea area 236 via trench 232. In addition, when the lid 246 is in its open position, the positioning of the hinge pin 252 below the trench 232 provides an open area 257 forming a venturi to enhance water flow through the channel 232. In addition, conduits 32, 132 and 232 may be utilized to provide water flow therethrough (in a reverse direction) from the inner harbor area 42 into the open sea area 36. This may be effectuated by positioning a one way valve or a suitable one of lid mechanisms 44, 156, 70, 84 or 244 at the inlet 3, 138 or 238. Thus, when the water level in the inner harbor area 42 is higher than the water level in the open sea area 36 contaminated water will flow from the inner harbor area 42 into the open sea area 36 via conduit 32, 132 or 232. This may be particularly desirable in those harbors in which sewage (or other pollutants) is emptied directly into the inner harbor area 42 by a contaminated river, sewage treatment plant or other means.

Accordingly, there has been provided, in accordance with the invention, a system and method for cleansing a harbor which is economical to construct and use. It is to be understood that all the terms used herein are descriptive rather than limiting. Although the invention has been described in conjunction with the specific embodiments set forth above, many alternative embodiments, modifications and variations will be apparent to those skilled in the art in light of the disclosure set forth herein. Accordingly, it is intended to include all such alternative embodiments, modifications and variations that fall within the spirit and scope of the invention as set forth in the claims hereinbelow.

I claim:

1. In a body of water having means for connecting a first and a second area, and wherein said areas exhibit a water elevation differential, and consequently a water pressure differential, and wherein flow of water is established in said means for connecting which is responsive to said water pressure differential, a system for controlling said flow of water comprising:

a base having a chamber connected to said first area;

an upper air bag mounted within said chamber;

a lid rotatably connected to said means for connecting;

an air line interconnecting said upper air bag and said lower air bag so that water pressure acting on said upper air bag forces air therein into said lower air bag to increase buoyancy of said lid in order to generally open said lid and allow water flow therethrough between the first area and the second area.

2. In a body of water having means for connecting a first and a second area, and wherein said areas exhibit a water elevation differential, and consequently a water pressure differential, and wherein flow of water is established in said means for connecting which is responsive to said water pressure differential, a system for controlling said flow of water comprising:

a lid rotatably connected to said means for connecting;

a lower air bag mounted on said lid;

a compressor; and an air line interconnecting said lower air bag and said compressor to allow air from said compressor to generally inflate said lower air bag to increase its buoyancy in order to generally open said lid and allow water flow therethrough between the first area and the second area.

3. The system of claim 2 further including a sensor for monitoring water pressure in the first area, said sensor connected to said compressor to automatically actuate said compressor in response to the water elevation differential.

4. A system for cleansing a polluted harbor by achieving general circulation of water between an open ocean and the polluted harbor based on natural wave-like characteristics of cyclic ocean tides, where the tides propagated along a path in the open ocean, through a substantially unobstructed harbor entrance, and thence through the harbor to a back harbor, the system comprising:

a conduit having first and second openings, said openings located substantially along the path of propagation of the tide, said openings having sufficient relative separation to exhibit a hydrostatic pressure differential, said conduit enabling fluid communication responsive to said hydrostatic pressure differential to permit flow of water through said conduit;

said first opening located near the harbor entrance in a first area containing clean water;

said second opening located within the harbor in a second area containing polluted water;

a control valve in at least one of said openings responsive to cyclic hydrostatic pressure differentials resulting from the cyclic ocean tides, said control valve converting said cyclic hydrostatic pressure differential to unidirectional flow of water in said conduit, wherein said control valve is a one-way valve; and said at least one of said openings is inclined a slant angle, said slant angle being substantially between 30 and 60 degrees, so that said slant angle allows a maximum quantity of water flow through said at least one of said openings following minimum control valve actuation.

5. A system according to claim 4 wherein said control valve comprises a lid rotatably connected to said at least one of said openings and positioned relative thereto so that the hydrostatic pressure differential acting on said lid causes it to rotate into an open position to allow water flow through said at least one of said openings.

6. The system of claim 5 wherein said lid is positioned so that kinetic energy of water flowing against said lid maintains it in a generally open position.

7. The system of claim 6 wherein said lid is positioned so that water flowing in an opposite direction produces swirls around said lid, said swirls creating a force thereon causing said lid to close.

* * * * *